US009017176B2

(12) United States Patent
Hettich

(10) Patent No.: US 9,017,176 B2
(45) Date of Patent: Apr. 28, 2015

(54) METHOD AND ROLLING DIE FOR PRODUCING A SCREW WITH A VARIABLE THREAD PITCH

(75) Inventor: Ulrich Hettich, Schrambergt (DE)

(73) Assignee: Ludwig Hettich & Co., Schramberg-Sulgen (DE)

( * ) Notice: Subject to any disclaimer, the term of this patent is extended or adjusted under 35 U.S.C. 154(b) by 467 days.

(21) Appl. No.: 13/548,790

(22) Filed: Jul. 13, 2012

(65) Prior Publication Data

US 2012/0309548 A1 Dec. 6, 2012

(30) Foreign Application Priority Data

Jan. 14, 2011 (WO) ..... PCT/EP2011/000154

(51) Int. Cl.
*B21H 3/06* (2006.01)

(52) U.S. Cl.
CPC ..... *B21H 3/06* (2013.01)

(58) Field of Classification Search
CPC ..... B23G 5/00; B23G 5/04; B21H 3/06
USPC ..... 470/8–10, 58, 59, 185; 72/88, 90, 72/102–104, 469
See application file for complete search history.

(56) References Cited

U.S. PATENT DOCUMENTS

2013/0051954 A1* 2/2013 Levey ..... 411/378

FOREIGN PATENT DOCUMENTS

| | | | |
|---|---|---|---|
| DE | 602004004057 | T2 | 7/2007 |
| JP | 48038066 | B | 11/1973 |
| WO | 2009015754 | | 5/2009 |

OTHER PUBLICATIONS

International Searching Authority, English translation of the International Preliminary Report on Patentability PCT/EP2011/000154, Aug. 16, 2012, 8pgs.

* cited by examiner

*Primary Examiner* — Debra Sullivan
(74) *Attorney, Agent, or Firm* — Duane Morris, LLP

(57) ABSTRACT

Disclosed herein is a method for manufacturing a screw comprising a continuous thread with a variable thread pitch, in which method a blank is rolled between two rolling dies, wherein in each rolling die a rolling profile is formed that comprises a host of curved non-parallel depressions. The depressions are designed and arranged in such a manner that during rolling no volume transport, or as little volume transport as possible, in the axial direction takes place, or a volume transport from a region of the blank where a thread section with a larger thread pitch is to be formed, to a region in which a thread section with a smaller thread pitch is to be formed takes place.

15 Claims, 5 Drawing Sheets

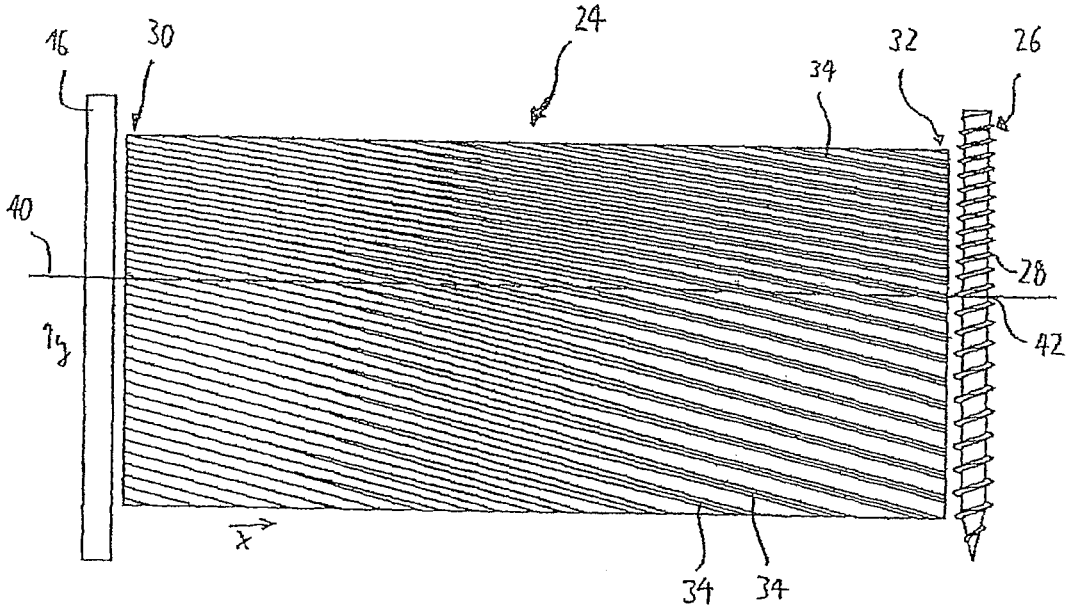
Fig. 2A
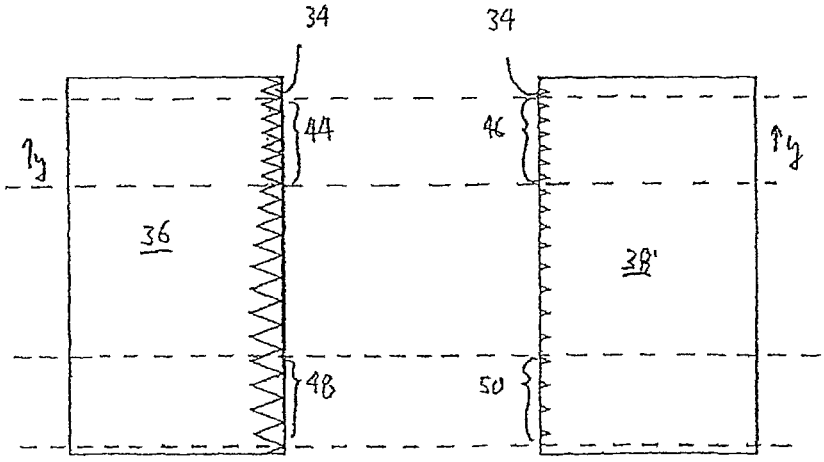
Fig. 2B
Fig. 2C

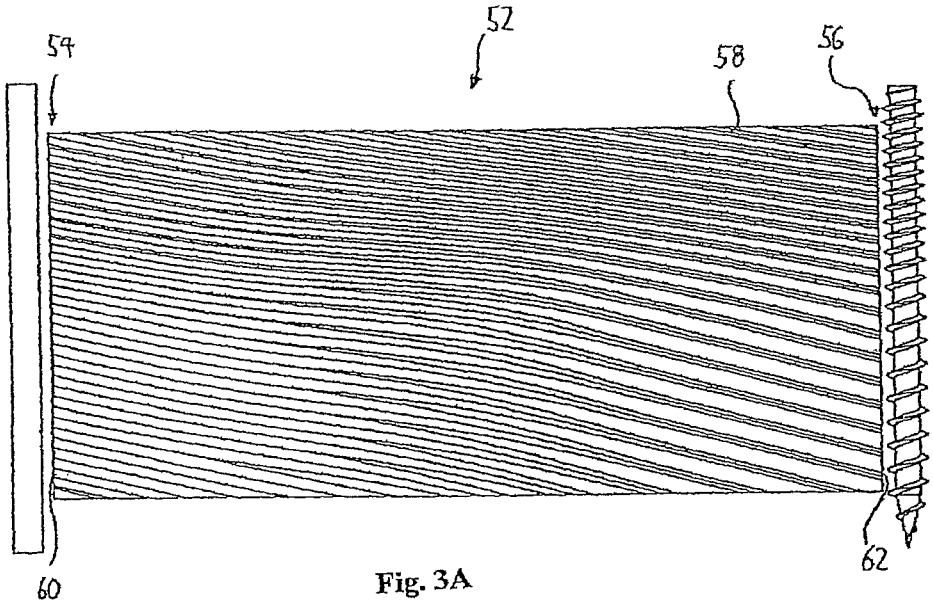
Fig. 3A
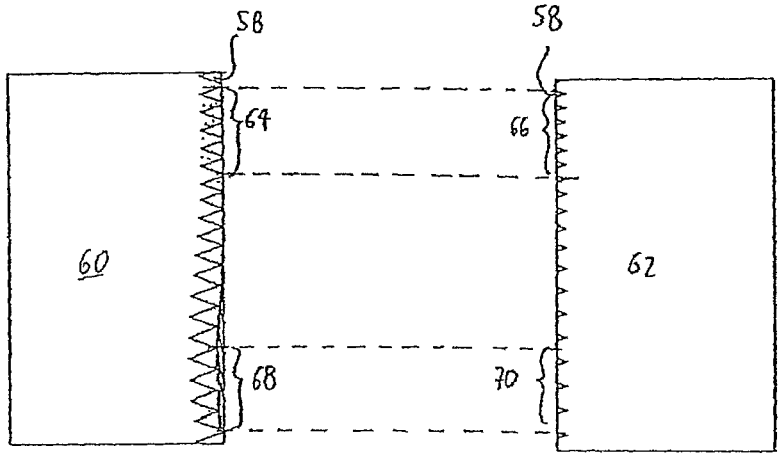
Fig. 3B
Fig. 3C

METHOD AND ROLLING DIE FOR PRODUCING A SCREW WITH A VARIABLE THREAD PITCH

BACKGROUND TO THE INVENTION

The present invention relates to a method and a means for manufacturing a screw comprising a continuous thread with a variable thread pitch. In this document, the term "continuous thread" defines a single uninterrupted thread, in contrast to two separate threads on a screw.

RELATED PRIOR ART

A screw with a continuous thread with a variable thread pitch is, for example, described in WO 2009/015754. By means of a suitable variation in the thread pitch, residual stress can be generated in the bond between the screw and a component when the screw is driven into the component. According to the teaching of the above-mentioned patent specification, the variation in the thread pitch is to be selected such that the residual stress acts against a bond stress that occurs when the component is subjected to loads, so that at least the stress peaks of the resulting bond stress are reduced when the component is subjected to loads. Such a screw with a variable thread pitch can, for example, be used for reinforcing components, e.g. boardwork bearers, or for introducing forces into a component.

In order to manufacture a screw with a desired variable thread pitch, it makes sense to mill the thread from a blank. Modern metal cutting machines can be programmed relatively easily according to the desired thread design. However, this approach is associated with disadvantage in that there is a relatively large loss of material during machining, and in that there is a comparatively extended duration of machining, which limits throughput.

SUMMARY OF THE INVENTION

It is the object of the invention to provide a method for manufacturing a screw with a continuous thread with a variable thread pitch, which method can be implemented quickly and economically, and to state means for implementing this method.

This object is met in a first embodiment by the method according to claim 1, and in a second embodiment by a method according to claim 2. Furthermore, the object is met by a rolling die according to claim 8 or a rolling die according to claim 9. Advantageous embodiments are defined in the dependent claims.

In the method according to the invention a blank is rolled between two rolling dies, wherein in each rolling die a rolling profile is formed that comprises a host of curved non-parallel depressions. This is a significant difference when compared to known rolling methods for forming threads with constant thread slopes, in which threads the rolling profile is formed by a host of straight parallel depressions that are arranged equidistantly from each other.

According to the first embodiment the depressions are designed and arranged in such a manner that as a result of a virtual displacement in the direction of rolling by a constant distance T the centre lines of adjacent depressions can be aligned. Furthermore, the slopes of the centre lines, which slopes are defined as the quotient of the changes in the position of the centre line in the direction transverse and in the direction parallel to the direction of rolling, at the respective intersections of the centre lines with a line that is parallel to the direction of rolling are identical. Moreover, these slopes are proportional to the thread pitch in the section of the finish-rolled screw corresponding to said line, i.e. the section of the screw that is formed by a section of the rolling die that extends along the aforementioned lines that are parallel to the direction of rolling.

To this extent the course of each individual depression, more precisely its centre line, reflects the course of the variable pitch of the finished screw.

The inventor has found that, with the use of a rolling die designed in this manner, a screw with a variable thread pitch can in practical application be formed in an uncomplicated manner and—surprisingly to the inventor—with little rolling pressure. As a result of the above-defined geometry of the depressions according to the first exemplary embodiment, apart from rolling material into the depressions for forming the thread, there is practically no material transfer in the axial direction of the blank, and consequently the rolling forces can be kept astonishingly low.

The uncomplicated behaviour during rolling with this geometry of the rolling die is surprising to the average person skilled in the art. For example, the inventor knows of attempts for forming two separate threads with a different, but in each case constant, thread pitch on one blank in the same rolling process by means of a two-piece rolling die. In practice, this has proven difficult because the blank has a tendency to tilt across the direction of rolling. It is a surprising result of the rolling method according to the first embodiment that no such tilting occurs during rolling, but that variable threads of excellent quality can be rolled in a simple and uncomplicated manner instead.

The above-described geometry of the depressions of the rolling profile is thus selected in such a manner that the volume transport of the material in the axial direction is minimal, and this is considered to be a reason for the relatively low rolling pressure and the uncomplicated rolling behaviour. However, the inventor has found that an orderly volume transport in the axial direction can be desirable at times. Assuming the blank is cylindrical and thus comprises a constant volume per unit length, this means that after a rolling process without volume transport in the axial direction the finish-rolled thread, too, over its entire length comprises a constant volume per unit length. However, in a region with a small thread pitch, i.e. with a lower lead, the screw requires in fact more material per unit of length in order to form the thread than is the case in a region with a large pitch. If this additionally required material is not available during rolling, it can happen that the thread diameter in the region of a small thread pitch decreases, or, in other words, that the thread is not being completely "filled" in the rolling process. Hereinafter, the local lack of material is also referred to as a "volume defect". For this reason it would be advantageous, in particular applications, if, during the rolling process, material from such axial sections of the blank where a thread section of a greater pitch is to be formed is transferred to an axial region in which a thread section with a smaller pitch is to be formed.

According to the second embodiment this can be achieved in that the slope of the centre lines of the depressions at a first end of the rolling die where the rolling process of the blank commences, is varied relative to the slope at the—when viewed in the direction of rolling—opposite section of a second end of the rolling die, at which end the rolling process is completed. For, if the slopes of the depressions, or in other words the space between the depressions in a region of the first end, is increased when compared to the—when viewed in the direction of rolling—opposite region of the second end, during rolling this results in contraction of the corresponding section of the blank so that material is transported into the corresponding axial region of the finished screw. The opposite effect occurs if the slope or the pitch between adjacent depressions in the region of the first end of the rolling die is reduced relative to the slope in the corresponding region at the second end. During rolling this results in material transport of a volume of material out of the corresponding axial region.

This principle can be used to advantage in order to compensate for the above-described volume defect in thread sections with a small thread lead. According to the second embodiment the rolling profile is thus selected so that the following inequation applies:

$$\frac{P_{21}}{P_{11}} < \frac{P_{22}}{P_{12}},$$

wherein $P_{21}$ denotes the mean slope of the (centre line of the) depressions in a first region at the second end of the rolling die, which slope is smaller than the mean slope $P_{22}$ of the depressions in a second region at the second end of the rolling die, and wherein $P_{11}$ and $P_{12}$ denote the mean slopes in those regions at the first end of the rolling die which—when viewed in the direction of rolling—are opposite the first or the second region. In this document, the term "opposite when viewed in the direction of rolling" means that the corresponding regions are delimited by two lines that are parallel to the direction of rolling.

It should be noted that in contrast to this, in the geometry of the first embodiment $P_{21}=P_{11}$ and $P_{22}=P_{12}$ applies, so that both fractions in the above equation result in 1, which indicates a lack of volume transport in the axial direction.

In addition or as an alternative, a volume defect can also be compensated for in that for the finish-rolled thread in a region with a smaller thread lead a smaller cross section of the thread ridge is selected by varying the flank angle and/or the thread depth. Thus with less available material the same thread diameter can be produced.

Preferably, in the rolling die those depressions whose centre lines in the region of the first end of the rolling die have a larger slope are deeper in the region of the first end of the rolling die than those depressions whose centre lines in the region of the first end of the rolling die have a smaller slope. Since depressions with a larger slope in the region of the first end are spaced further apart from each other, it is advantageous for the rolling process if these depressions are deeper. Preferably, the depressions in the region of the first end of the rolling die are V-shaped in cross section and their depth is proportional, at least within ±10%, to the slope of the centre line at the first end of the rolling die.

BRIEF DESCRIPTION OF THE FIGURES

Further advantages and characteristics of the invention are set out in the following description, in which the invention is described with reference to two exemplary embodiments with reference to the enclosed drawings. Herein:

FIG. 2A shows a top view of a rolling die according to a first embodiment of the invention, as well as of a blank and of a finish-rolled thread;

FIG. 2B shows a top view of an end face of the rolling die of FIG. 2A at its first end;

FIG. 2C shows a top view of an end face of the rolling die of FIG. 2A at its second end;

FIG. 3A shows a top view of a rolling die according to a second embodiment of the invention, as well as of a blank and of a finish-rolled thread;

FIG. 3B shows a top view of an end face of the rolling die of FIG. 3A at its first end;

FIG. 3C shows a top view of an end face of the rolling die of FIG. 3A at its second end.

DESCRIPTION OF THE PREFERRED EMBODIMENTS

Figure 1A:
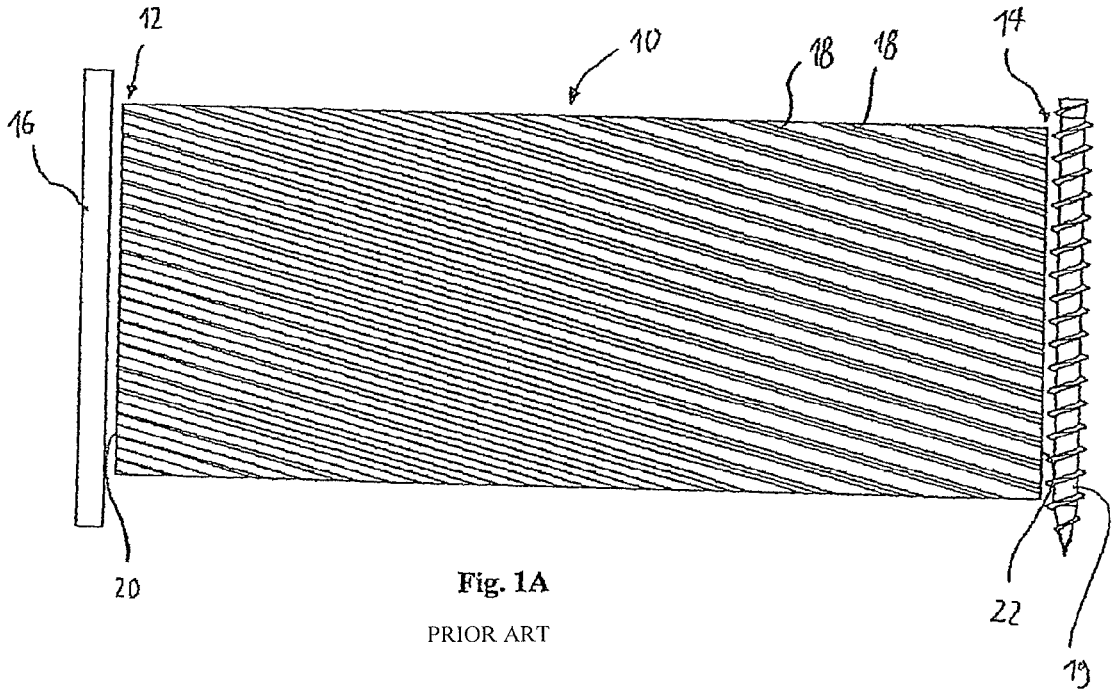
Fig. 1A PRIOR ART
FIG. 1A shows a top view of a rolling die according to the prior art for rolling a thread with a constant thread pitch, and of a blank and of a finish-rolled thread.

FIG. 1A shows a top view of a rolling die 10 according to the state of the art, by means of which a screw with a constant thread pitch can be rolled.

Figure 1B:
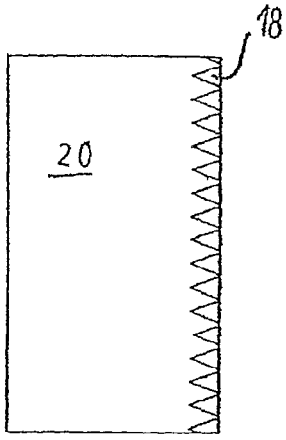
Fig. 1B PRIOR ART
FIG. 1B shows a top view of an end face of the rolling die of FIG. 1A at its first end.
Figure 1C:
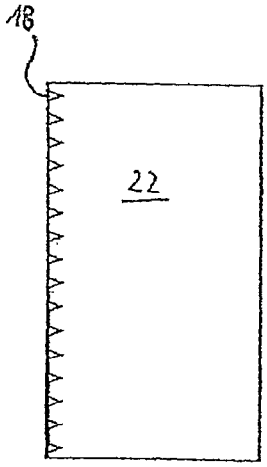
Fig. 1C PRIOR ART
FIG. 1C shows a top view of an end face of the rolling die of FIG. 1A at its second end.

The rolling die 10 comprises a first end 12 and a second end 14. During the rolling process a blank 16 is rolled from the first end 12 of the rolling die 10 towards the second end 14. The surface of the rolling die 10 comprises a rolling profile that is formed from a multitude of straight, parallel and equidistant depressions 18. The depressions 18 in the region of the first or second end 12, 14 are shown in FIGS. 1B and 1C, which in each case show a top view of one of the end faces 20, 22 of the rolling die 10. A screw 19 with a finish-rolled thread is shown close to the second end 14 of the rolling die 10.

As shown in FIGS. 1A, 1B and 1C the cross section of the depressions 18 between the first and the second end 12, 14 of the rolling die 10 changes. However, the cross sections of all the depressions 18 at the first end 12 are identical (see FIG. 1B), and the same applies to the cross sections 18 at the second end of the rolling die 10 (see FIG. 1C). Furthermore, the centre lines of the depressions 18 are arranged so as to be parallel to each other and equidistant from each other.

FIG. 2A shows a top view of a rolling die 24 that is suitable for a method for manufacturing a screw 26 with a continuous thread 28 with a variable thread lead, which screw 26 is also shown in FIG. 2A. The screw 26 can be made from a blank 16 that is identical to the one shown in the embodiment of FIG. 1A, which blank 16 is rolled from a first end 30 of the rolling die 24 towards a second end 32. FIG. 2E shows a perspective view of the rolling die 24. FIG. 2B and FIG. 2C show top views of end faces 36 or 38 in the region of the first and second ends 30, 32 of the rolling die 24, respectively.

Figure 2D:
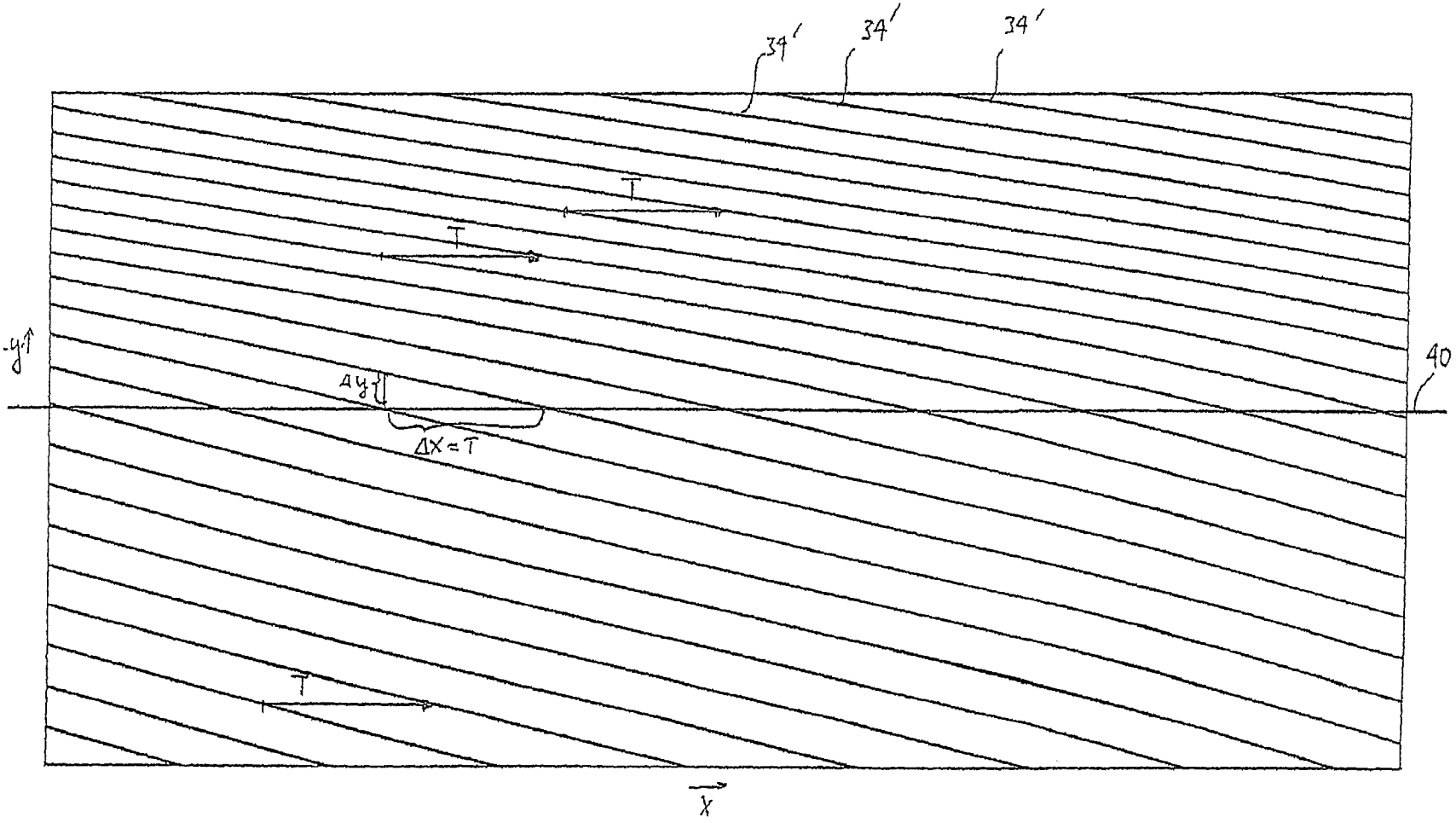
FIG. 2D shows an enlarged and simplified top view of the rolling die of FIG. 2A.
Figure 2E:
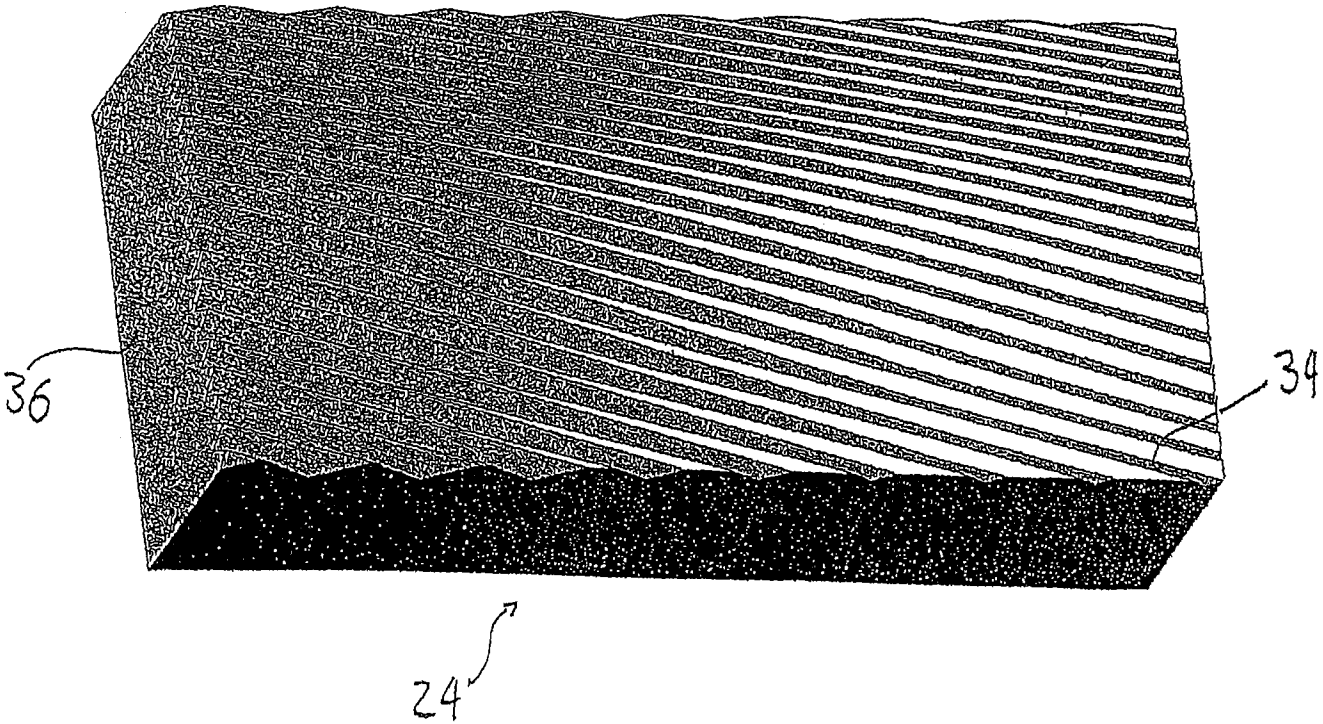
FIG. 2E shows a perspective view of the rolling die of FIG. 2A.

As shown in FIG. 2A, the rolling profile of the rolling die 24 comprises a multitude of elongated depressions 34, which however, in a manner that differs from that of the rolling die 10 of FIG. 1A, are not straight, not parallel and not equidistant. The geometry of the depressions 34 is described in more detail with reference to FIG. 2D, which shows an enlarged top view of the rolling die 24 and which for the sake of clarity only shows the centre lines 34' of the respective elongate depressions 34.

As shown in FIG. 2D, in each case the centre lines 34' of two adjacent depressions are designed and arranged in such a manner that they can be aligned as a result of a virtual shift in the direction of rolling by a constant distance T. The centre lines 34' have a slope that is defined as the quotient of the changes Δy and Δx of the position of the centre line in the direction transversal (y-direction) or parallel (x-direction) to the direction of rolling, respectively. Because of the translation symmetry in the direction of rolling, the slopes of each centre line at the respective intersections with a line 40 that is parallel to the direction of rolling are identical, and this slope is proportional to the thread pitch in the section 42, of the finished screw 26 which corresponds to the line 40 (see also FIG. 2A).

FIGS. 2B and 2C show that the distances between adjacent depressions 34 in the y-direction, i.e. in a direction transverse to the direction of rolling, change both at the first and at the second ends 30, 32 of the rolling die 24. This change in spacing reflects the variable thread pitch, because the spacing denotes a "local" pitch of the screw, in other words the local thread slope of the screw. It should be noted that the local thread slope $P=dy/d\phi$ is proportional to the slope $\Delta y/\Delta x$ shown in FIG. 2D, because during rolling of the blank a certain distance Δx corresponds to a certain rolling angle Δϕ.

However, it should be noted that the mean pitch or slope of the depressions 34 in—when viewed in the direction of rolling—opposite regions at the first and second ends 30, 32 of the rolling die 24 are identical. For clarification, FIG. 2B shows a first region 44 of the first end, and FIG. 2C shows a first region 46 of the second end of the rolling die 24. Each of these regions comprises six depressions 34, which means that the mean pitch of the depressions 34 in the opposite regions 44, 46 is identical.

Furthermore, FIG. 2B shows a second region 48 of the first end of the rolling die 24, with the width of said region 48 corresponding to the width of the first region 44, in which, however, the mean pitch (slope) of the depressions 34 is larger, because only four depressions fit into the region 48. The second region 48 of the first end is opposite a second region 50 of the second end, in which second region 50 the mean pitch is larger than in the first section 46 of the second end, but equal to the mean pitch in the opposite section 48 of the first end.

The fact that the mean slopes in—when viewed in the direction of rolling—opposite sections 44/46 or 48/50 at the first and at the second ends 30, 32 of the rolling die 24 are identical results in there being practically no material volume transport (with the exception of the transport during filling of the depressions 34) in the axial direction of the blank (or the y-direction of the rolling die 24). Consequently the rolling process can be carried out with relatively modest rolling forces, and can be carried out simply and quickly.

Furthermore, experiments carried out by the inventor have shown that the blank 16, during rolling by means of the rolling profile of FIG. 2A or 2D, shows no inclination to assume a crosswise position, and consequently the screw 26 with the continuous thread with a variable pitch—surprisingly to the inventor—can be rolled easily and in an uncomplicated manner.

There is a further difference between the rolling die 24 according to the first embodiment and the rolling die 10 of FIGS. 1A to 1C from the prior art, in that such depressions 34, whose centre lines in the region of the first end 30 of the rolling die 24 have a larger slope are deeper in the region of the first end 30 than those whose centre line in the region of the first end 30 has a smaller slope, as is clearly shown in FIG. 2B. In contrast to this, in the rolling die 10 of FIG. 1B the depths of all depressions 18 at the first end 12 of the rolling die 10 are identical. By matching the milling depth of the depressions 34 in the region of the first end 30 of the rolling die 24 to the slope or distance between adjacent depressions (pitch), it can be ensured that peaks are formed between two adjacent depressions, which peaks are all at least approximately on the same level and thus establish contact with the blank 16 at the same time. As shown in FIG. 2B, in the first embodiment the depressions 34 in the region of the first end 30 of the rolling die 24 are V-shaped in cross section, and their depth is proportional to the slope of the centre line 34' in the region of the first end 30 of the rolling die 24, or to the distance between adjacent depressions 34.

Since the blank 16 that is used is cylindrical in shape and thus comprises a constant volume per unit of length, a screw 26 that has been manufactured with the use of the rolling die 24 also has a constant volume per unit of length, because the geometry of the rolling profile has been selected in such a manner that a volume transport in the axial direction is avoided during rolling of the blank 16. However, in a region with a smaller thread pitch where the windings are spaced more closely together, the finished screw 26 requires more material. If the thread pitch greatly varies along the thread of the screw, it can happen that during rolling the thread may not be completely "filled" in some locations because insufficient material is present, in other words that the diameter of the thread is reduced in this region.

Hereinafter, the lack of material in the region of a smaller thread pitch is referred to as a "volume defect". This patent specification proposes three approaches for compensating for the volume defect.

A first solution provides for the use of a blank with a variable cross section, instead of a cylindrical blank. In regions in which a thread section with a small thread pitch is to be formed, the proposed blank comprises a somewhat larger diameter than in regions in which a section with a comparatively large thread pitch is to be formed. However, this solution is less advantageous in that it requires expensive manufacture of the blank.

A second solution provides for varying the cross section of the thread ridge of the thread 28 by varying the flank angle and/or the thread depth in such a manner that in a region with a smaller thread slope or pitch the finish-rolled thread ridge comprises a smaller cross-sectional area, and in this way the volume defect is compensated for. The thread can thus have a more acute flank angle so that the thread, when viewed in longitudinal section of the screw, is narrower and comprises a more acute flank, and thus less material is used. In the method according to the first embodiment this can be implemented in a very simple manner by forming the widths of the depressions 34 at the second end of the rolling die 24 so as to be narrower and/or less deep in regions with a smaller thread pitch.

The third and preferred solution provides for the rolling profile to be designed in such a manner that a targeted volume transport from regions with a larger thread pitch into regions with a smaller thread pitch is caused, which volume transport just compensates for the volume defect. This third variant is described in the second embodiment, which hereinafter is described with reference to FIGS. 3A to 3C.

FIG. 3A shows a top view of a rolling die 52 according to a second embodiment of the present invention, which rolling die 52 comprises a first end 54 and a second end 56. In a manner similar to that shown in FIG. 2A, the rolling die 52 has a rolling profile comprising a multitude of elongated, curved, non-parallel depressions 58. The course of the depressions 58 is based on the one shown in FIG. 2A but has been additionally modified with a view to a special intended volume transport.

FIGS. 3B and 3C in turn show the top view of the end faces 60 or 62 of the first and second ends 54, 56 of the rolling die 52, respectively. As is shown by a comparison of FIG. 2C with FIG. 3C, the rolling profile in the second embodiment at the second end 56 of the rolling die 52 is identical to that at the second end 32 of the rolling die 24 of the first embodiment. This is due to the fact that the rolling process is completed at the second end, and that in this process, apart from the correction of the volume defect, with both embodiments the same screw type is to be manufactured. The difference between the first embodiment and the second embodiment consists of the shape of the rolling profile at the first end of the rolling die 52, as is shown by a comparison of FIG. 3B with FIG. 2B.

According to the second embodiment of FIGS. 3B and 3C, the thread slopes or pitches in—when viewed in the direction of rolling—opposite sections of the first and second ends 54, 56 of the rolling die 52 are no longer identical. FIG. 3B shows a first region 64 of the first end 54 of the rolling die 52, which region 64 comprises five depressions 58. This region is opposed—when viewed in the direction of rolling—at the second end 56 of the rolling die 52 by a region 66 that comprises six depressions 58. In other words the mean pitch $P_{11}$ in the first region 64 of the first end 54 is larger than the mean pitch $P_{21}$ in the first region 66 of the second end 58. As a result of this, during rolling of the blank 16 an axial material transport to the section of the thread corresponding to region 66, takes place. Since the thread section that corresponds to the region 66 is a section with a small thread pitch, in this manner the volume defect described above can be compensated for in this region.

The opposite effect occurs in a second region 70 at the second end 56 of the rolling die 52, which region 70 is opposite a second region 68 at the first end 54 of the rolling die 52—when viewed in the direction of rolling. As FIGS. 3B and 3C show, the mean pitch $P_{22}$ of the second region 70 at the second end of the rolling die 52 is larger than the mean pitch $P_{12}$ at the—when viewed in the direction of rolling—opposite region 68, which means that material transport out of the section of the thread corresponding to region 70 takes place. This is expedient, because the corresponding region of the thread is a region with a high thread pitch, where therefore less material per unit of length is used for forming the thread.

It should be noted that by means of a variation in the thread pitch in—when viewed in the direction of rolling—opposite sections at the first and second ends of the rolling die, both a global elongation or contraction of the thread and a redistribution of materials in the axial direction can be achieved. However, for correcting the volume defect described above, global elongation or contraction is not sufficient; instead, material from a region with a larger thread pitch must be transferred to a region with a smaller thread pitch. A criterion for such redistribution is provided by the following inequation:

$$P_{21}/P_{11}<P_{22}/P_{12},$$

wherein $P_{21}$ denotes the mean slope of the depressions in a first region at the second end of the rolling die, $P_{22}$ denotes the mean slope of the depressions in a second region at the second end of the rolling die, and $P_{11}$ and $P_{12}$ denote the mean slopes in the regions at the first end of the rolling die, which regions are opposite—when viewed in the direction of rolling—the first and the second regions, respectively, and wherein, furthermore, $P_{21}<P_{22}$ applies. The above inequation thus defines a local redistribution of material in the axial direction, which redistribution goes beyond a global elongation or contraction.

The rolling die of FIGS. 3A to 3C can, for example, be constructed as follows: the rolling die without volume transport, as shown in FIG. 2A, can be the starting point. The geometry of the depressions of the rolling die without volume transport can then be constructed, starting from a desired form of the finished screw and using the criteria mentioned in connection with FIGS. 2A to 2E. As mentioned above, in this arrangement the mean slopes in—when viewed in the direction of rolling—opposite sections at the first and second ends of the rolling die are at first identical. In a second step the slopes at the first end can then be varied in such a manner that the desired volume transport results. To this effect, preferably, a correction value dp(i) is added to the slope of the i-th depression at the first end, which correction value is calculated as follows:

$$dp(i) = \frac{\Delta V(i)}{d_{G0}^2 \pi / 4},$$

wherein ΔV denotes the volume defect of the i-th winding and $d_{G0}$ denotes a "cylindrical substitute diameter" of the finished thread, i.e. the diameter of a substitute cylinder that has the same length and the same volume as the finished thread. In this arrangement dp(i) denotes the change in slope for each angle change Δφ, which is proportional to a change ΔX in the depressions in the direction of rolling.

In this manner the slope corrections at the first end can be calculated in respect of each winding. The correction results in a shift of the depressions at the first end of the rolling die, as is shown by a comparison of FIG. 3B with FIG. 2B. The individual depressions can then be modified by smooth functions in such a manner that they result in the desired variation at the first end of the rolling die and the desired thread form at the second end of the rolling die.

It should be noted that in the rolling dies 24 of FIG. 2 or 52 of FIG. 3 the slopes of the centre lines 34' of the depressions 34 change continuously. Graphically speaking, this means that the depressions are not kinked at any point, which would correspond to a sudden change in the thread pitch of the rolled screw. Such sudden changes would result if the finished screw were to comprise a series of thread sections with different thread slopes that are, however, constant within the section. A corresponding rolling die may possibly be easier to construct but more involved to manufacture than the rolling dies disclosed in this document. The rolling dies shown in this document, with their smooth depressions without any kinks, can be made with the use of milling methods. This is not possible without further ado in rolling dies with kinked depressions. While it would be possible to compose the rolling die at the kinked positions from several separately-manufactured components, the inventor has, however, established that such a composite rolling die has a tendency to be prone to excessive wear. As an alternative it would be possible to manufacture a rolling die with kinked depressions in an erosion method, which is, however, significantly more expensive than a milling method. For this reason, the rolling die with a smooth kink-free course of the depressions has been shown to be particularly advantageous.

LIST OF REFERENCE SIGNS

10 rolling die
12 first end of the rolling die 10
14 second end of the rolling die 10
16 blank
18 depression
19 screw
20 end surface at the first end of the rolling die 10
22 end surface at the second end of the rolling die 10

24 rolling die
26 screw
28 thread of the screw 26
30 first end of the rolling die 24
32 second end of the rolling die 24
34 depression
34' centre lines of the depressions 34
36 end surface at the first end of the rolling die 24
38 end surface at the second end of the rolling die 24
40 line parallel to the direction of rolling
42 section of the thread 28
44 first region at the first end of the rolling die
46 first region at the second end of the rolling die 24
48 second region at the first end of the rolling die 24
50 second region at the second end of the rolling die 24
52 rolling die
54 first end of the rolling die 52
56 second end of the rolling die 52
58 depression
60 end surface at the first end of the rolling die 52
62 end surface at the second end of the rolling die 52
64 first region at the first end of the rolling die 52
66 first region at the second end of the rolling die 52
68 second region at the first end of the rolling die 52
70 second region at the second end of the rolling die 52

I claim:

1. A method for manufacturing a screw comprising the steps of:

providing two rolling dies, wherein on each rolling die a rolling profile is formed that comprises a plurality of curved non-parallel depressions, and wherein each rolling die has a first and a second end spaced apart from each other in the direction of rolling, wherein the direction of rolling points from the first end towards the second end of each rolling die, respectively, and wherein as a result of a virtual displacement in the direction of rolling by a constant distance the center lines of adjacent depressions can be aligned, and wherein the slopes of the center lines, being defined as the quotient of the changes in position of the center line in directions transverse and parallel to the direction of rolling, respectively, are identical at the intersections of the center lines with a line that is parallel to the direction of rolling; and rolling a blank between the two rolling dies to form on the blank a continuous thread with a variable pitch, such that:

depressions in a region of the second end are designed in such a manner that a first region of the continuous thread has thread pitch $T_1$ and flank angle $A_1$, and a second region of the continuous thread has thread pitch $T_2$ and flank angle $A_2$, wherein $T_1<T_2$ and $A_1<A_2$, or a depression in a first region of the first end of each rolling die has depth $D_1$ and has a center line with slope $S_1$, and a depression in a second region of the first end has depth $D_2$ and has a center line with slope $S_2$, wherein $D_1>D_2$ and $S_1>S_2$.

2. A method for manufacturing a screw comprising the steps of:

providing two rolling dies, wherein on each rolling die a rolling profile is formed that comprises a plurality of curved non-parallel depressions, and wherein each rolling die has a first end and a second end spaced apart from each other in the direction of rolling, wherein the direction of rolling points from the first end towards the second end of each rolling die, respectively, and wherein for one of the rolling dies the mean slope $P_{21}$ of the depressions in a first region at the second end of said rolling die is smaller than the mean slope $P_{22}$ of the depressions in a second region at the second end of said rolling die, and wherein the following applies:

$$P_{21}/P_{11}<P_{22}/P_{12}$$

wherein $P_{11}$ and $P_{12}$ denote the mean slope in a first and a second region, respectively, at the first end of said rolling die, which, when viewed in the direction of rolling, are opposite the first and second regions of the second end, respectively; and rolling a blank between the two rolling dies to form the screw with a continuous thread with a variable thread pitch.

3. The method according to claim 2, wherein depressions in a region of the second end are designed in such a manner that a first region of the continuous thread has thread pitch $T_1$ and flank angle $A_1$, and a second region of the continuous thread has thread pitch $T_2$ and flank angle $A_2$, wherein $T_1<T_2$ and $A_1<A_2$.

4. The method according to claim 2, wherein the depressions in a third region at the second end of each rolling die, in which the mean thread pitch is smaller than in a fourth region at the second end of each rolling die, are narrower than in the fourth region.

5. The method according to claim 2, wherein a depression in a first region of the first end of each rolling die has depth $D_1$ and has a center line with slope $S_1$, and a depression in a second region of the first end of each rolling die has depth $D_2$ and has a center line with slope $S_2$, wherein $D_1>D_2$ and $S_1>S_2$.

6. The method according to claim 5, wherein the depression in a region of the first end of the rolling die is V-shaped in cross section and its depth is proportional, at least within ±10%, to the slope of the center line.

7. The method according to claim 1, wherein the pitch of the thread changes continuously.

8. A rolling die for manufacturing a screw with a continuous thread with a variable thread pitch, comprising:

said rolling die having a rolling profile that comprises a plurality of curved non-parallel depressions, and wherein said rolling die has a first and a second end, which ends are spaced apart from each other in the direction of rolling, wherein the direction of rolling points from the first end towards the second end of the rolling die, wherein as a result of a virtual displacement in the direction of rolling by a constant distance the center lines of adjacent depressions can be aligned, and wherein the slopes of the center lines, being defined as the quotient of the changes in the position of the center line in directions transverse and parallel to the direction of rolling, respectively, are identical at the respective intersections of the center lines with a line that is parallel to the direction of rolling, and wherein the depressions in the region of the second end are designed in such a manner that the continuous thread in a region with a smaller thread pitch has a more acute flank angle than in a region with a larger thread pitch, or wherein those depressions whose center lines in the region of the first end have a larger slope, are deeper in the region of the first end than those whose center lines in the region of the first end have a smaller slope.

9. A rolling die for manufacturing a screw with a continuous thread with a variable thread pitch, comprising:

said rolling die having a rolling profile comprising a plurality of curved non-parallel depressions, wherein said rolling die has a first end and a second end spaced apart from each other in the direction of rolling, and wherein the mean slope $P_{21}$ of the depressions in a first region at the second end of said rolling die is smaller than the mean pitch $P_{22}$ of the depressions in a second region at the second end of said rolling die, and wherein the following applies:

$$P_{21}/P_{11}<P_{22}/P_{12}$$

wherein $P_{11}$ and $P_{12}$ denote the mean slope in a first and a second region, respectively, at the first end of said rolling die, which when viewed in the direction of rolling, are opposite the first and second regions of the second end, respectively.

10. The rolling die according to claim 9, wherein depressions in a region of the second end are designed in such a manner that a first region of the continuous thread has thread pitch $T_1$ and flank angle $A_1$, and a second region of the continuous thread has thread pitch $T_2$ and flank angle $A_2$, wherein $T_1<T_2$ and $A_1<A_2$.

11. The rolling die according to claim 10, wherein the depressions in a third region at the second end of the rolling die, in which the mean thread pitch is smaller than in a fourth region at the second end of the rolling die, are narrower than in the fourth region.

12. The rolling die according to claim 8, wherein a depression in a first region of the first end of each rolling die has depth $D_1$ and has a center line with slope $S_1$, and a depression in a second region of the first end has depth $D_2$ and has a center line with slope $S_2$, wherein $D_1>D_2$ and $S_1>S_2$.

13. The rolling die according to claim 12, wherein the depression in a region of the first end of the rolling die is V-shaped in cross section and its depth is proportional, at least within ±10%, to the slope of the center line.

14. The rolling die according to claim 8, wherein the slopes of the centre lines of the depressions vary continuously.

15. A method for manufacturing a screw comprising the steps of:

providing two rolling dies, wherein on each rolling die a rolling profile is formed that comprises a plurality of curved non-parallel depressions, and wherein each rolling die has a first and a second end spaced apart from each other in the direction of rolling, wherein the direction of rolling points from the first end towards the second end of each rolling die, respectively, and wherein as a result of a virtual displacement in the direction of rolling by a constant distance the center lines of adjacent depressions can be aligned, and wherein the slopes of the center lines, being defined as the quotient of the changes in position of the center line in directions transverse and parallel to the direction of rolling, respectively, are identical at the intersections of the centre lines with a line that is parallel to the direction of rolling; and rolling a variable cross-section blank between the two rolling dies to form on the blank a continuous thread with a variable pitch, wherein the blank has a larger diameter in a region in which a thread section with a smaller thread pitch is to be formed, than in a region in which a thread section with a larger thread pitch is to be formed.

* * * * *